United States Patent [19]

Weinstein

[11] Patent Number: 4,912,080

[45] Date of Patent: Mar. 27, 1990

[54] CARBONLESS TRANSFER SHEETS FOR MULTI-PART FORMS PACKS

[76] Inventor: Philip M. Weinstein, 3240 W. Bruce Dr., Dresher, Pa. 19025

[21] Appl. No.: 68,878

[22] Filed: Jul. 1, 1987

[51] Int. Cl.[4] ..... B41M 5/22

[52] U.S. Cl. ..... 503/200; 162/126; 162/134; 162/135; 162/137; 427/150; 427/151; 427/152; 428/211; 428/537.5; 428/914; 503/214; 503/215; 503/226

[58] Field of Search ..... 427/150–152; 428/488.1, 488.4, 537.5, 211, 914; 503/200, 214, 226, 215; 162/126, 135, 134, 137

[56] References Cited

U.S. PATENT DOCUMENTS 4,112,138 9/1978 Davis et al. ..... 427/150

4,162,165 7/1979 Schwab ..... 428/327

4,186,243 1/1980 Astbury et al. ..... 427/150

*Primary Examiner*—Pamela R. Schwartz

*Attorney, Agent, or Firm*—Ratner & Prestia

[57] ABSTRACT

Pressure sensitive carbonless transfer sheets are made capable of producing clear images by light impact marking means in multi-part carbonless forms packs containing at least six of the sheets, such as 8–12 sheets, by coating a chromogenic material onto a paper sheet characterized by a basis weight of 9–11 lbs, a thickness of 40–50 microns, a Gurley porosity of 400–4000 seconds, and a Bendtsen smoothness of 120–260 ml/min on the wire side and 100–280 ml/min on the felt side. Bar codes are also transferrable with good scannability through forms packs containing three or more of the sheets.

19 Claims, No Drawings

CARBONLESS TRANSFER SHEETS FOR MULTI-PART FORMS PACKS

TECHNICAL FIELD

This invention relates to pressure sensitive carbonless paper sheets capable of image formation by light impact marking means in multi-part forms packs, and to forms packs containing the sheets .

BACKGROUND OF THE INVENTION

With the advent of electronic typewriters and computers and the need for multiple copy forms packs, attention has focused on the rapid recording of information on forms packs with a variety of printers. While it is possible to produce forms packs on which information can be recorded through multiple "parts" (plies) of carbonless paper with heavy-impact printers, many electronic typewriters and printers associated with computer keyboards are light-impact in the sense that the printing mechanisms utilize light force marking means. Typical of such typewriters and computer actuated printers are dot matrix and daisy wheel printers. These printers are effective for data entry on carbonless forms packs of three or four parts, and in some cases even five part forms, but clarity on the last (bottom) parts is diminished when the forms packs contain six or more parts, and data becomes illegible when eight or more copies are desired.

Another problem is the scannability of bar codes on the individual sheets of a carbonless forms pack. It has not been possible, heretofore, to obtain sufficient quality of transfer of bar codes, even in only three part packs, such that all sheets in the pack are scannable. For this reason, bar codes have been pre-printed on the individual sheets of form packs. Obviously, it would be advantageous to be able to produce carbonless multi-part forms packs where bar codes as well as other indicia can be transferred with clarity to all sheets of the pack.

Carbonless paper is produced commercially by coating a paper sheet with a composition, preferably a hot melt composition, containing a chromogenic material which develops an image when the sheet is contacted with a marking force. Marking forces may be either manual (such as the pressure exerted by a pen, pencil or other hand-held stylus) or machine actuated (such as the styli or characters of dot matrix or daisy wheel printers). Chromagenic materials comprise color precursors, color formers, color receptors, color inhibitors and other image-generating substances, including mixtures of two or more thereof, which interact chemically to develop an image. Generally, a chromogenic material is encapsulated or otherwise protected by a film or other material which is ruptured by the marking force to cause contact of the chromogenic material with air or other actuating (developing) medium to induce the color change defining the image.

Typically, a chromogenic material comprises a microencapsulated color precursor either alone or suspended in a liquid color receptor (developer). When the color precursor only is in the coating composition, a second coating composition containing the color receptor is applied over the first coating, or the color receptor coating is applied to the obverse side of the sheet or to another sheet superposed on the sheet coated with the color precursor. It is also possible to encapsulate the color receptor and maintain the color precursor as the continuous phase in the coating (on the same surface as the color receptor or on the surface of another sheet superposed on the sheet coated with the color receptor). Also, each of the color precursor and color receptor may be encapsulated. The interactive color forming reagents may also be isolated from one another (until brought into contact by a marking force) by other means such as an intervening rupturable sheet or film.

In one common form of forms pack, the top sheet (called the "record" sheet because it receives the marking force directly) is coated with a composition containing a color receptor. This coating is termed a "CF" coating. The bottom sheet in the pack is coated with a composition, preferably a hot melt composition, containing microencapsulated color precursor material. This coating is called a "CB" coating. The intervening sheets in the pack are coated on one surface with the CF coating and on the obverse surface with the CB coating. These sheets are therefore called "CFB" sheets. Both the bottom sheet and the intervening sheets are called "transfer" sheets.

In another embodiment of forms packs, a single composition, comprising an encapsulated color precursor dispersed in a continuous phase containing a color developer, is coated on the front surface of a paper sheet, thus defining a transfer sheet. Multiples of such transfer sheets are superposed under a single, uncoated, top record sheet to form copies of the markings imposed on the record sheet. These packs are said to be "self-contained" because both of the interactive materials required to form an image of a marking are in the same coating.

Representative hot melt coating processes preferably used for the production of pressure sensitive carbonless transfer sheets are disclosed in U.S. Pat. Nos. 4,063,754, 4,137,343, 4,139,218, 4,139,392, 4,143,890, 4,203,619, 4,336,067, 4,112,138 and 4,097,619. The foregoing patents (the disclosures of which are incorporated herein by reference) not only describe hot melt coating compositions and systems for the production of carbonless transfer sheets and forms packs, but also a variety of chromogenic materials, both encapsulated and non-encapsulated, useful in the production of carbonless paper.

Accordingly, there exists a critical need for a pressure sensitive carbonless transfer sheet capable of providing from light impact printers, clear copies throughout forms packs containing at least six of the transfer sheets, and more usually eight or more parts such as the 8–12 part forms now in demand by government agencies and industry.

SUMMARY OF THE INVENTION

It has now been discovered that by using a paper sheet having certain critical properties and coating the sheet on at least one surface with a composition containing a chromogenic material dispersed therein, there can be produced pressure sensitive carbonless transfer sheets which are capable of transferring clear images by light impact marking means throughout forms packs containing at least six of the sheets. In fact, by virtue of the invention, forms packs can now be produced containing 8–12 parts or more which produce clear copies even though marked or printed by light impact marking means such as daisy wheel or dot matrix printers. Furthermore, the invention now makes feasible carbonless forms packs wherein bar codes are transferable with good scannability through three or more sheets, thus avoiding preprinting of the bar codes on each sheet of the pack.

The paper sheet which enables achievement of the foregoing advantages is primarily characterized by a basis weight of 9–11 pounds, a thickness of 40–50 microns, a Gurley porosity of 400–4000 seconds, and a Bendtsen smoothness of 120–260 ml/min on the wire side and 100–280 ml/min on the felt side. These properties have been found to control the absorbency and transfer of chromogenic material in and through a carbonless paper sheet such that even the bottom parts in a six part or more multi-ply carbonless forms pack will develop clear images with light impact, and bar codes can be transferred for good optical scannability through three or more sheets.

Desirably, the paper sheet additionally will possess other characteristics for specific applications, including suitable tensile strength, elastic modulus and opacity, and be treated with the requisite type and quantity of sizing for use in particular environments. The paper sheet should also have a requisite formation to fit each mode of use, although this property tends to be subjective and primarily visual.

Various other properties may be appropriate in certain cases. The nature and tests for the foregoing and other properties of paper sheets intended for use in forms packs are well known to those skilled in the art of paper making.

DETAILED DESCRIPTION

More particularly, the paper sheets for use in the carbonless forms packs of the invention must have at least the following characteristics to achieve the benefits of the invention:

1. Basis weight: 9–11 lbs, preferably about 10 lbs. Basis weight for the purposes of the present invention is the weight in pounds of a ream of paper on a 17×22 scale, i.e., 500 sheets each having dimensions of 17 by 22 inches. Other scales may be used to define the basis weight with concomitant adjustments in weights relative to the 17×22 scale.

2. Thickness (caliper): 40–50 microns preferably 44–48 microns, most preferably about 46 microns. Thickness is conventionally measured with a micrometer having clamping faces 0.56 inch to 0.65 inch in diameter and applied with a pressure of 7–9 lbs per inch. The testing instrument can be operated manually or electrically. Typical of the latter is a TMI 549M motorized micrometer operated according to TAPPI Test Standard T411. A 5 inch multiple thickness of paper samples, taken across the machine web of the paper, is measured. The reading is the average of various readings taken at uniform intervals across the sample.

3. Porosity: 400–4000 seconds, preferably 1000–3000 seconds, most preferably about 1600 seconds. This is determined by forcing air through a paper sample and measuring the air flow by a Gurley Porosimeter as the time in seconds for 100 cc of air to pass through the paper. The higher the number of seconds the tighter the sheet.

4. Bendtsen Smoothness: 120–260 ml/min (preferably 170–260 ml/min, most preferably about 200 ml/min) on the wire (bottom) surface and 100–280 ml/min (preferably 120–240 ml/min, most preferably about 180 ml/min) on the felt (top) surface. Smoothness is necessary for good printability of forms indicia. The smoother a surface, the higher the Bendtsen value and the more uniform the ink layer will be. Good smoothness also reduces the amount of coating required to deposit a chromogenic material and thereby improves image transfer. Bendtsen units are the European measure of smoothness: Elsewhere, smoothness is more usually measured in Sheffield units. The units are correlatable. Measurements are made both on the bottom (wire side) of the sheet and on the top (felt side), the former being the surface in contact with the paper forming wire and the latter being the opposing side, usually in contact with a felt layer on a belt. The units of measurement are milliliters (cc) of air passing per minute over one square inch of surface area. The measurement is an average of a plurality of measurements at uniform intervals across a sample.

The foregoing properties are interrelated. For example, while low thickness may seem to be highly critical for good transfer through multiple copies of carbonless paper, merely reducing the thickness of paper will not be sufficient unless the paper also has the requisite smoothness to provide a continuum of strike-through of the light impact marking means to sheets lower in a forms pack. Similarly, a basis weight which is below the enumerated range will not provide sufficient bulk and strength so that the paper can be advanced smoothly in a pin-operated printer and can withstand a marking force through at least six plies. Lastly, the higher the Gurley porosity, the tighter the sheet, which in turn affects the ability of the coated paper to withstand heat without blistering in heat-set printing and to accept adhesives.

Other properties to be considered, although not critical to use of paper sheets in carbonless forms, include: tensile strength—the force to breakage measured as grams per inch in the machine direction or in the cross direction of the paper; elastic modulus (stretch)—measured as a percentage in the machine direction; capacity—measured as percent reflectance of light (TAPPI method); brightness—also a percent reflectance of light but with color disregarded (ISO method); Ash—measure of the amount of additive in the paper (such as filler, clay and/or titanium dioxide) measured as a percentage of the area of a piece of paper which burns to ash; and Cobb sizing—a measure of the resistance of paper to penetration of an aqueous solution as the weight in grams per square meter of paper of the water absorbed in one minute from one side or the other of the paper. The higher the number, the lower the amount of sizing and the more absorbent the paper.

The following are typical measurements of paper sheets for optimization of use in carbonless forms packs: opacity (TAPPI)—83–90%, preferably about 85%; brightness (ISO)—75–88%, preferably about 84%; tensile strength—at least 8000 g/in, preferably about 9300 g/in; ash—8–23%, preferably about 18%; stretch—0.8–1.6%, preferably about 1.4%; and Cobb sizing—8/20 g/m$^2$, preferably 12–16 g/m$^2$, most preferably about 14 g/m$^2$, as measured on a Cobb 60 meter. It will be understood that considerable variation is possible in the foregoing secondary properties depending upon the particular composition of the paper, the number of sheets intended to be used in the forms packs and similar considerations.

Commercially available papers particularly suited for use in the present invention have the following properties wherein the units and methods of measurement are as described above.

| | Target | Minimum | Maximum |
|---|---|---|---|
| Basis weight, lbs. | 10 | 9.5 | 10.5 |
| Thickness, microns | 46 | 44 | 48 |
| Gurley porosity, seconds | 1600 | 1000 | 3000 |
| $Cobb_{60}$ Sizing, $g/m^2$ | 14 | 12 | 16 |
| Tensile MD, g/in. | 9300 | 8500 | — |
| Stretch MD, % | 1.4 | 0.8 | 1.6 |
| Opacity, TAPPI, % | 85 | 83 | 90 |
| Brightness, ISO, % | 84 | 83 | 85 |
| Ash, % | 18 | 15 | 20 |
| Smoothness, Bendtsen, ml/min. | | | |
| Wire side | 200 | 170 | 260 |
| Felt side | 180 | 120 | 240 |

Coating compositions containing chromogenic materials as well as techniques for applying the compositions, particularly by hot melt coating, are well known, as described, for example, in the U.S. Patents cited above. One commercial system for manufacturing carbonless paper from base paper stock having the characteristics set forth above is the OPAS ( On/Off Press Application System) marketed by Mead Paper, a division of Mead Corporation. The OPAS system includes a standard off-set printing tower to apply CF coating on the front (top) of the paper web, and a hot melt coater to apply a CB coating on the back of the paper. Both operations can be effected simultaneously with printing of the paper. In forms packs of more than two parts, the intermediate sheets are coated on the front surfaces with a CF coating containing a color receptor to receive the image from the preceding sheets, and are hot melt coated on the back surfaces with a CB activator (colorless dye precursor) for transfer of the image to the succeeding sheets.

Typical CF and CB coatings as well as CFB transfer sheets are described in detail in the patents cited above, such as U.S. Pat. No. 4,143,890 the description of which is incorporated herein by reference. In U.S. Pat. No. 4,143,890, there are described preferred chromogenic materials useful in the present invention, such as a color precursor of the electron donating type and a color receptor of the electron accepting type, but other types of chromogenic materials may be employed in the coating compositions of the present invention.

From the patent and commercial literature, it will be evident that the carbonless transfer sheets and forms packs of the invention may comprise several different arrangements depending upon the number of parts in the forms pack and whether the chromogenic material is a "self-contained" system as described above. Generally, a transfer sheet of the invention will comprise a paper sheet having the basis weight, thickness, Gurley porosity and Bendtsen smoothness defined above and will be coated on at least one surface thereof with a hot melt composition containing a chromogenic material dispersed therein. The chromogenic material may be "self-contained", that is, may comprise both a color precursor and a color receptor, or the chromogenic material in one coating may be a color precursor and the chromogenic material in the coating on the obverse surface or on the surface of another sheet may be a color receptor. In either case, one or both of the color precursor and color receptor will be encapsulated or some other temporary barrier will be maintained therebetween. The barrier is ruptured by impact with a marking means during data entry on the sheet, causing contact between the color precursor and color receptor, and consequent chemical interaction and color formation in a configuration defined by the marking stylus. If the forms pack is a two-part pack only, one surface of the first sheet may contain either the color precursor or the color receptor chromogenic material and the other sheet may be coated with the other of the color precursor and color receptor chromogenic material. For more economic and efficient production, it will be advantageous to produce a single form of sheet and then incorporate a plurality of such sheets in superposed relationship to form the forms pack. Such transfer sheets may be of the CFB type or the self-contained type.

It will thus be evident that the invention provides significant benefits to the carbonless forms industry in that for the first time, forms packs of at least six and preferably eight to twelve or more parts can be used to record information clearly in all of the parts when using light impact force or printing equipment such as daisy wheel and dot matrix printers, and bar codes can now be transferred with good scannability through carbonless forms packs containing three or more of the sheets.

In view of the foregoing description, it will be apparent that the invention is not limited to the specific details set forth therein for purposes of illustration, and that various other modifications are equivalent for the stated and illustrated functions without departing from the spirit of the invention and the scope thereof as defined in the appended claims.

I claim:

1. A pressure sensitive carbonless transfer sheet, capable of image formation by light impact marking means in multi-part forms packs containing at least six of the sheets, comprising a paper sheet having a hot melt coating on at least one surface thereof, at least one of the coatings having a chromogenic material dispersed therein, wherein the paper sheet is characterized by a basis weight of 9–11 lbs for a ream of 500 sheets of paper each having dimensions of 17 by 22 inches, a thickness of 40–50 microns, a Gurley porosity of 400–4000 seconds, and a Bendtsen smoothness of 120–260 ml/min on the wire side and 100–280 ml/min on the felt side.

2. The transfer sheet of claim 1 wherein the paper sheet is characterized by a basis weight of 9–11 lbs for a ream of 500 sheets of paper each having dimensions of 17 by 22 inches, a thickness of 44–48 microns, a Gurley porosity of 1000–3000 seconds, and a Bendtsen smoothness of 170–260 ml/min on the wire side and 120–240 ml/min on the felt side.

3. A pressure sensitive carbonless forms pack comprising a plurality of superposed transfer sheets of claim 2.

4. The forms pack of claim 3 comprising at least six of the superposed sheets.

5. The transfer sheet of claim 1 herein the chromogenic material comprises a color precursor of the electron donating type or a color receptor of the electron accepting type, said color precursor or color receptor materials being encapsulated.

6. The transfer sheet of claim 5 wherein the encapsulated chromogenic material comprises said color precursor.

7. The transfer sheet of claim 1 wherein said coating is on both surfaces of the sheet, the coating on the back surface comprising a hot melt composition containing a chromogenic material comprising a color precursor of the electron donating type, and the coating on the front surface comprising a composition containing a chromogenic material comprising a color receptor of the electron accepting type, one of the color precursor and color receptor materials being encapsulated.

8. The transfer sheet of claim 1 wherein the coating is on one surface of the sheet, the coating comprising a hot melt composition containing a first chromogenic material comprising a color precursor of the electron donating type and a second chromogenic material comprising a color receptor of the electron accepting type, one of the color precursor and color receptor materials being encapsulated.

9. A pressure sensitive carbonless forms pack comprising a plurality of superposed transfer sheets of claim 1.

10. The forms pack of claim 9 comprising at least six of the superposed sheets.

11. A transfer sheet of claim 1 in which the basis weight is from about 10 to about 11 lbs for a ream of 500 sheets of paper each having dimensions of 17 by 22 inches, the thickness is from about 42 to about 46 microns, the Gurley porosity is about 1600 seconds, and the Bendsten smoothness is about 130 ml/min. on the wire side and about 100 ml/min. on the felt side.

12. A pressure sensitive carbonless multi-part forms pack, comprising a plurality of superposed transfer paper sheets, the front and back sheets in the pack having coatings on at least one surface thereof, the coating on one of the front and back sheets having dispersed therein a chromogenic material comprising a color receptor of the electron accepting type, each of the intermediate sheets in the pack having coatings on both surfaces thereof, the coating on one surface of the intermediate sheets being a hot melt coating having dispersed therein a chromogenic material comprising a color precursor of the electron donating type, the coating on the obverse surface of the intermediate sheets having dispersed therein a chromogenic material comprising a color receptor of the electron accepting type, one of the color precursor and color receptor materials being encapsulated, said intermediate sheets being arranged in the pack with surfaces coated with color precursor materials in face to face contact with adjacent surfaces coated with color receptor materials, and wherein the paper sheets are characterized by a basis weight of 9–11 lbs for a ream of 500 sheets of paper each having dimensions of 17 by 22 inches, a thickness of 40–50 microns, a Gurley porosity of 400–4000 seconds, and a Bendtsen smoothness of 120–260 ml/min on the wire side and 100–280 ml/min on the felt side.

13. The forms pack of claim 12 wherein the paper sheets are characterized by a basis weight of 9–11 lbs for a ream of 500 sheets of paper each having dimensions of 17 by 22 inches, a thickness of 44–48 microns, a Gurley porosity of 1000–3000 seconds, and a Bendtsen smoothness of 170–260 ml/min on the wire side and 120–240 ml/min on the felt side.

14. The forms pack of claim 13 comprising at least six of the superposed sheets.

15. The forms pack of claim 12 comprising at least six of the superposed sheets.

16. A pressure sensitive carbonless multi-part forms pack comprising a plurality of superposed transfer paper sheets, each of the sheets having a hot melt coating on one surface thereof, the sheets being arranged in the pack with coated surfaces in face to face contact with non-coated surfaces of adjacent sheets, the coatings having dispersed therein a first chromogenic material comprising a color precursor of the electron donating type and a second chromogenic material comprising a color receptor of the electron accepting type, one of the first and second chromogenic materials being encapsulated, and wherein the paper sheets are characterized by a basis weight of 9–11 lbs for a ream of 500 sheets of paper each having dimensions of 17 by 22 inches, a thickness of 40–50 microns, a Gurley porosity of 400–4000 seconds, and a Bendtsen smoothness of 120–260 ml/min on the wire side and 100–280 ml/min on the felt side.

17. The forms pack of claim 16 wherein the paper sheets are characterized by a basis weight of 9–11 lbs for a ream of 500 sheets of paper each having dimensions of 17 by 22 inches, a thickness of 44–48 microns, a Gurley porosity of 1000–3000 seconds, and a Bendtsen smoothness of 170–260 ml/min on the wire side and 120–240 ml/min on the felt side.

18. The forms pack of claim 17 comprising at least six of the sheets.

19. The forms pack of claim 16 comprising at least six of the sheets.

* * * * *